US008237621B2

(12) United States Patent
Masuda et al.

(10) Patent No.: US 8,237,621 B2
(45) Date of Patent: Aug. 7, 2012

(54) SPIRAL ANTENNA

(75) Inventors: Yasuharu Masuda, Kawasaki (JP); Masahiro Tanabe, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 301 days.

(21) Appl. No.: 12/466,874

(22) Filed: May 15, 2009

(65) Prior Publication Data

US 2010/0066624 A1 Mar. 18, 2010

(30) Foreign Application Priority Data

Sep. 12, 2008 (JP) ..... 2008-235645

(51) Int. Cl.
*H01Q 1/36* (2006.01)

(52) U.S. Cl. ..... 343/895

(58) Field of Classification Search ..... 343/700 MS, 343/702, 895, 873, 787–788
See application file for complete search history.

(56) References Cited

U.S. PATENT DOCUMENTS

| | | | | |
|---|---|---|---|---|
| 5,589,842 | A * | 12/1996 | Wang et al. | 343/787 |
| 5,797,084 | A * | 8/1998 | Tsuru et al. | 455/73 |
| 6,127,977 | A * | 10/2000 | Cohen | 343/700 MS |
| 7,019,695 | B2 * | 3/2006 | Cohen | 343/700 MS |
| 7,126,537 | B2 * | 10/2006 | Cohen | 343/700 MS |
| 7,132,986 | B2 * | 11/2006 | Inatsugu et al. | 343/700 MS |

FOREIGN PATENT DOCUMENTS

| | | |
|---|---|---|
| JP | 53-52339 | 5/1978 |
| JP | 62-105503 | 5/1987 |
| JP | 63-208309 | 8/1988 |
| JP | 5-75331 | 3/1993 |
| JP | 2000-252738 | 9/2000 |
| JP | 2006-222873 | 8/2006 |
| JP | 2007-235255 | 9/2007 |

OTHER PUBLICATIONS

Leila Youseft, et al., "Low Profile Wide Band Antennas Using Electromagnetic Bandgap Structures with Magneto-Dielectric Materials", Small and Smart Antennas Metameterials and Applications, IWAT '07, Mar. 21-23, 2007, pp. 431-434.

Jodie M, Bell, et al., "Ultrawideband Hybrid EBG/ Ferrite Ground Plane for Low-Profile Array Antennas", Antennas and Propagation Society International Symposium, 2007 IEEE, Jun. 9-15, 2007, pp. 1313-1316.

Office Action issued Mar. 15, 2011, in Japan Patent Application No. 2008-235645 (with English translation).

* cited by examiner

*Primary Examiner* — Huedung Mancuso
(74) *Attorney, Agent, or Firm* — Oblon, Spivak, McClelland, Maier & Neustadt, L.L.P.

(57) ABSTRACT

A spiral antenna includes an antenna element which is formed in a spiral pattern on a dielectric substrate, a cavity which is formed with a space provided between the antenna element, and a magnetic material which is arranged between the antenna element and the cavity. The cross-section of the spiral antenna is formed in a manner which the sum of a distance between the antenna element and the magnetic material and a thickness of the magnetic material increases from the center portion towards the outer circumference of the spiral.

6 Claims, 2 Drawing Sheets

SPIRAL ANTENNA

CROSS-REFERENCE TO RELATED APPLICATIONS

This application is based upon and claims the benefit of priority from prior Japanese Patent Application No. 2008-235645, filed Sep. 12, 2008, the entire contents of which are incorporated herein by reference.

BACKGROUND OF THE INVENTION

1. Field of the Invention

The present invention is related to a spiral antenna having a wideband characteristic.

2. Description of the Related Art

Spiral antennas which radiate electromagnetic waves only in a forward direction of the antenna have spaces arranged between the antenna and cavity which correspond to frequencies being used. In this cavity-backed spiral antenna, the space between an antenna element and the cavity depends on a wavelength which corresponds to the used frequency. Therefore, the space becomes wider.

Given this factor, there has been suggested a microstrip spiral antenna which secures wideband characteristics by arranging a radio wave absorbent on the bottom of the cavity (refer to Jpn. Pat. Appln. KOKAI Publication No. 2000-252738). However, although the wideband characteristics can be secured by arranging the radio wave absorbent on the bottom of the cavity as in this antenna, no effect which reduces the height from the cavity to the antenna can be obtained. Therefore, there has been a problem that a high antenna mounting space became necessary.

BRIEF SUMMARY OF THE INVENTION

According to an aspect of the present invention, there is provided a spiral antenna includes an antenna element formed in a spiral pattern on a dielectric substrate; a cavity formed by arranging a space between the antenna element; and a magnetic material arranged between the antenna element and the cavity, wherein a cross-section of the spiral antenna is formed in a manner which a sum of a distance between the antenna element and the magnetic material and a thickness of the magnetic material increases from a center portion towards an outer circumference of the spiral.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The following explains an embodiment of the present invention in detail by reference to the drawings.

Figure 1:
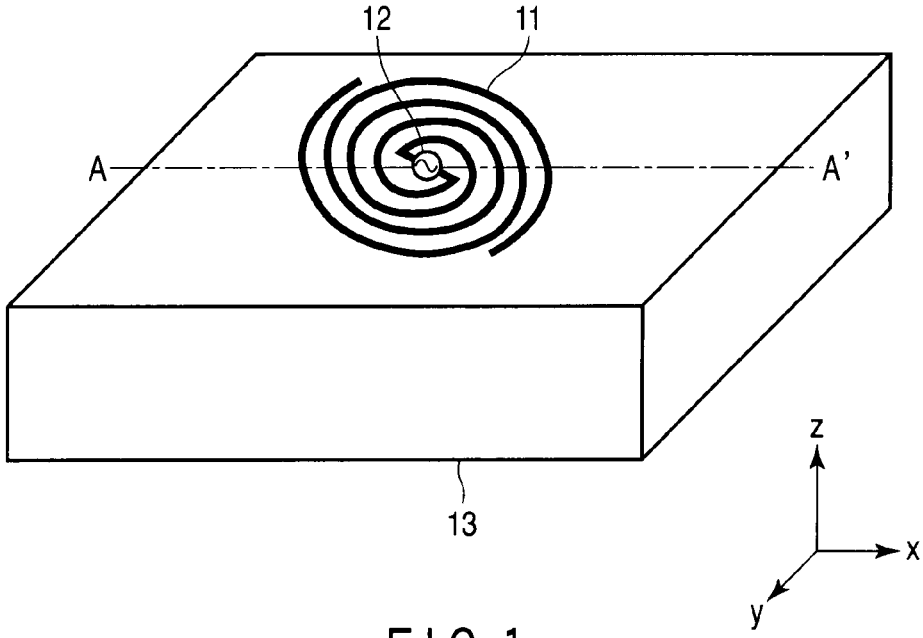
FIG. 1 is a perspective view of a spiral antenna profile according to an embodiment of the present invention.
Figure 2A:
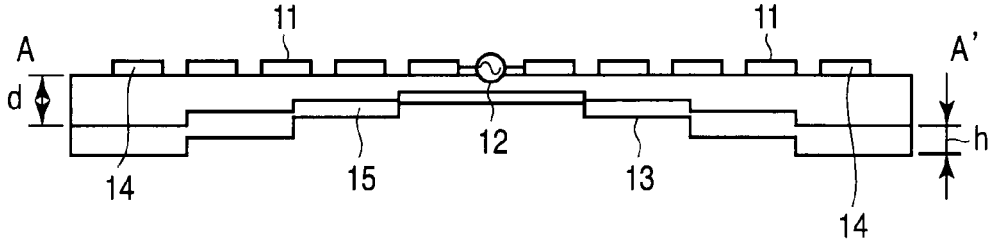
FIG. 2A is an example of an A-A' sectional view of the antenna shown in FIG. 1.
Figure 2B:
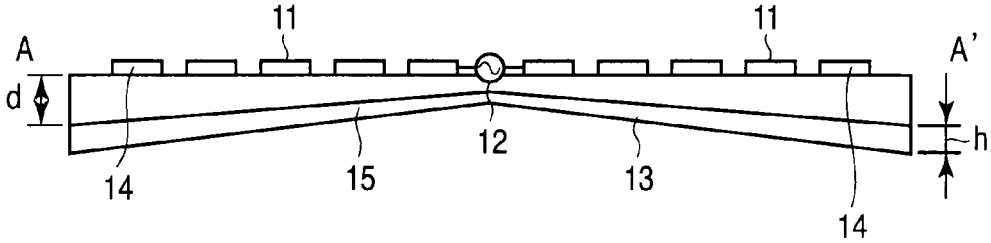
FIG. 2B is another example of an A-A' sectional view of the antenna shown in FIG. 1.

FIG. 1 is a perspective view of an antenna profile showing an embodiment of a spiral antenna of the present invention. FIGS. 2A and 2B are examples of an A-A' sectional view of the antenna shown in FIG. 1.

As shown in FIG. 1, this spiral antenna comprises an antenna element 11 which is formed on a dielectric substrate in a spiral pattern, and a metal cavity 13 which supports the dielectric substrate by providing a space between the antenna element 11. The antenna element 11 has a power feeding point 12 in the center portion of the circular spiral. Further, as shown in FIGS. 2A and 2B, this spiral antenna has a magnetic material 15 between the antenna element 11 and the cavity 13. As shown in FIGS. 2A and 2B, the cavity 13 and the magnetic material 15 are formed in a staircase pattern as in FIG. 2A or a slope as in FIG. 2B, in which the sum of a distance d between the antenna element 11 and the magnetic material 15 and a thickness h of the magnetic material 15, i.e. (d+h), increases so that the thickness gradually increases from the center of the antenna towards the outer circumference.

An operation of a spiral antenna configured in this manner will be explained.

This spiral antenna resonates at the outermost circumference of the antenna element 11 at a lower frequency (corresponding to an element shown as 14 in FIGS. 2A and 2B). Thereafter, with the rise in frequency, the resonance point moves toward the center of the spiral antenna (a direction approaching the power feeding point 12). In other words, as the resonance point approaches the power feeding point from the outer circumference of the spiral, wavelength becomes shorter.

When the distance between the antenna element 11 and the magnetic material 15 is d, the thickness of the magnetic material 15 is h, and the wavelength in a resonance frequency of the spiral antenna is $\lambda$, in a case where $(d/\lambda \times h/\lambda)$ satisfies a constant relation, a VSWR (Voltage Standing Wave Ratio) of the antenna is favorable, and antenna gain becomes constant. That is, when the resonance frequency doubles, the wavelength $\lambda$ becomes half, and d and h can respectively be halved. By adjusting the sum (d+h) of the distance d between the antenna element 11 and the magnetic material 15 and the thickness h of the magnetic material 15 in accordance with the above relation, the cross-section of the antenna can be made in a staircase pattern as shown in FIG. 2A, or aslope with intervals widening toward the direction of the outer circumference as shown in FIG. 2B.

As mentioned above, in the above embodiment, by changing the thickness h of the magnetic material and the distance d from the antenna element to the magnetic material in accordance with the resonance frequency of the spiral antenna, a constant gain is obtained in a wide frequency range, and the height of the antenna can be made lower than in a conventional spiral antenna. Accordingly, the above embodiment is capable of providing a spiral antenna which can reduce the profile of an antenna while securing wideband characteristics.

Figure 3:
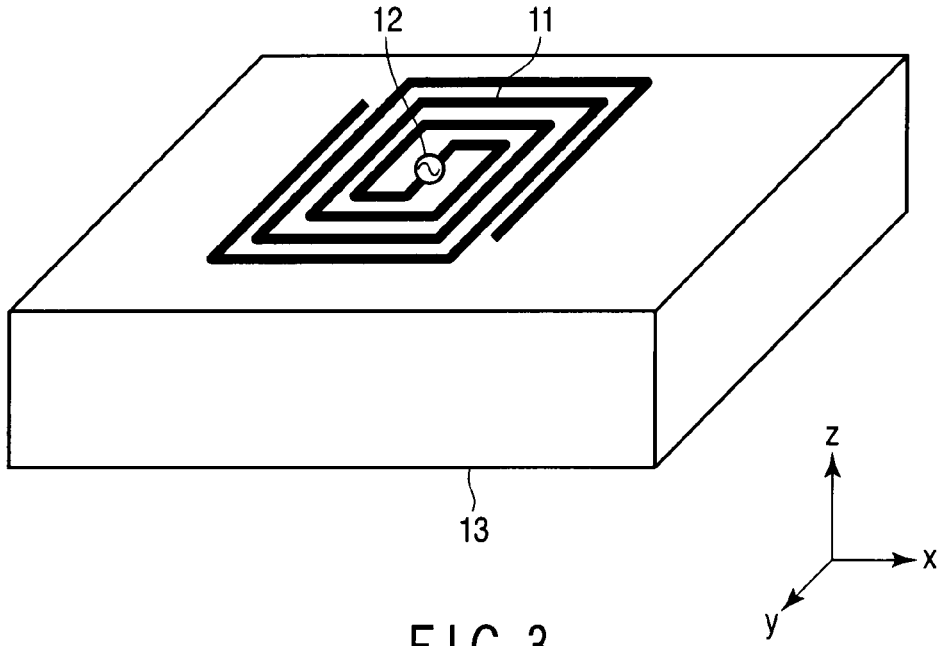
FIG. 3 is a perspective view of an antenna in which case the shape of a spiral is rectangular.

Further, this invention is not limited exactly to the embodiment mentioned above. For example, in the above embodiment, a circular spiral antenna has been mentioned. However, the shape need not necessarily be circular. For example, as shown in FIG. 3, even in the case where the shape of the spiral is polygonal, such as rectangular, the same effect can be obtained. Further, by adding a pair of spiral antennas to obtain a structure which has a total of two pairs of spiral antennas and two power feeding points, it is possible to obtain a spiral antenna which has the above mentioned effect and which can correspond to two orthogonal polarized waves (right-handed circularly polarized wave and left-handed circularly polarized wave).

Figure 4:
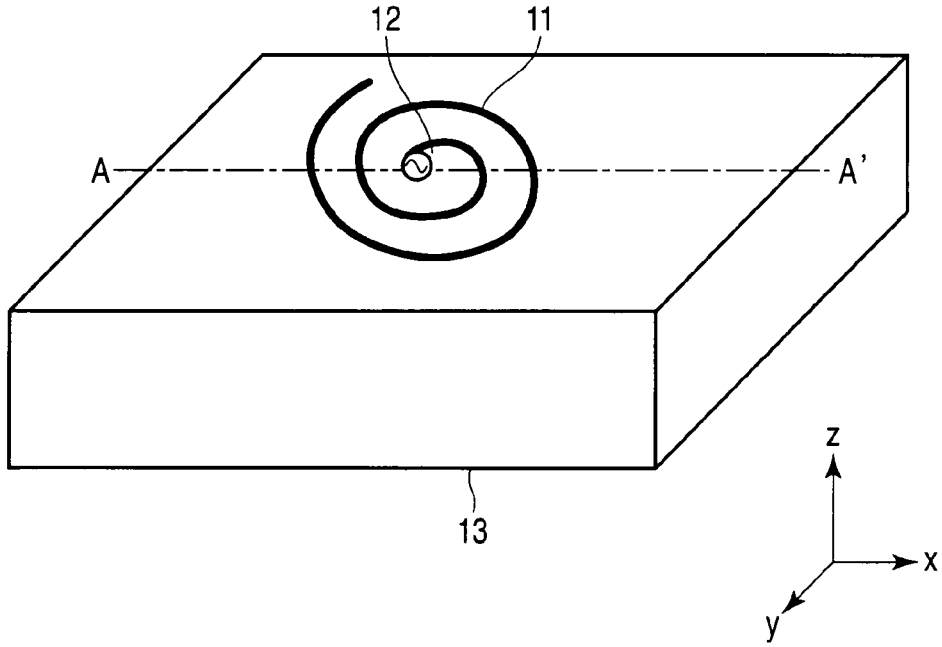
FIG. 4 is a perspective view of an antenna configuration which uses a one-point power feeding spiral antenna.

Further, in the above embodiment, the circular antenna element is described as having a power feeding point in the center (in the middle) of the spiral. However, as shown in FIG. 4, it may also be configured as a one-point power feeding spiral antenna which has a power feeding point at one end of the antenna element. Further, it may also be configured as a so called array antenna device which has a plurality of combinations of these spiral antennas arranged on a plane regularly or irregularly.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A spiral antenna which comprises:

an antenna element formed in a spiral pattern on a dielectric substrate;

a cavity provided separate from the antenna element; and a magnetic material arranged in the cavity, wherein a cross-section of the spiral antenna is formed in a manner which a sum of a vertical distance between the antenna element and the magnetic material and a thickness of the magnetic material increases from a center portion towards an outer circumference of the spiral pattern, such that the antenna element has a constant gain at a resonance frequency of the antenna element.

2. The spiral antenna according to claim 1, wherein the thickness of the magnetic material increases from the center portion of the spiral pattern toward the outer circumference of the spiral pattern.

3. The spiral antenna according to claim 1, wherein the cross-section is formed in a staircase pattern from the center portion towards the outer circumference of the spiral.

4. The spiral antenna according to claim 1, wherein the cross-section is formed aslope from the center portion towards the outer circumference of the spiral.

5. The spiral antenna according to claim 1, wherein a shape of the spiral is circular.

6. The spiral antenna according to claim 1, wherein a shape of the spiral is polygonal.

* * * * *